US011173590B2

(12) United States Patent
Tyler

(10) Patent No.: US 11,173,590 B2
(45) Date of Patent: Nov. 16, 2021

(54) SEAT INSERT TOOL

(71) Applicant: Caterpillar Inc., Deerfield, IL (US)

(72) Inventor: Brian G. Tyler, Trevor, WI (US)

(73) Assignee: Caterpillar Inc., Peoria, IL (US)

( * ) Notice: Subject to any disclaimer, the term of this patent is extended or adjusted under 35 U.S.C. 154(b) by 741 days.

(21) Appl. No.: 16/103,467

(22) Filed: Aug. 14, 2018

(65) Prior Publication Data

US 2020/0055172 A1 Feb. 20, 2020

(51) Int. Cl.
*B25B 27/24* (2006.01)

(52) U.S. Cl.
CPC ..... *B25B 27/24* (2013.01)

(58) Field of Classification Search
CPC . B25B 27/24; B25B 27/0028; B25B 27/0007; B25B 27/04; B25B 27/06; Y10T 29/53552; Y10T 29/53596; Y10T 29/53657; Y10T 29/53848; Y10T 29/53857; Y10T 29/53865
See application file for complete search history.

(56) References Cited

U.S. PATENT DOCUMENTS 6,502,293 B1 * 1/2003 Khurana ..... B25B 27/02 29/426.5
2011/0173814 A1 7/2011 Patel
2018/0029209 A1 2/2018 Nicholson

FOREIGN PATENT DOCUMENTS

CN 101362320 A 2/2009
CN 205950652 U 2/2017

* cited by examiner

*Primary Examiner* — Tyrone V Hall, Jr.
*Assistant Examiner* — Abbie E Quann
(74) *Attorney, Agent, or Firm* — Harrity & Harrity LLP

(57) ABSTRACT

A seat insert tool is disclosed. The seat insert tool may include a seat insert guide that is removably attachable to a threaded rod at an end of the threaded rod, and seat insert jaw that is slidable onto the threaded rod. The seat insert guide may include a key. The seat insert jaw may include a first keyway on a first side of the seat insert jaw and a second keyway on a second side of the seat insert jaw. The first keyway of the seat insert jaw may engage the key of the seat insert guide when the seat insert tool is used to remove a seat insert from a valve, and the second keyway of the seat insert jaw may engage the key of the seat insert guide when the seat insert tool is used to install the seat insert in the valve.

13 Claims, 5 Drawing Sheets

SEAT INSERT TOOL

TECHNICAL FIELD

The present disclosure relates generally to maintenance tools, more particularly, to a seat insert tool for removing and installing seat inserts in a valve.

BACKGROUND

A valve, such as a check valve, may allow a fluid to flow through the valve in a particular direction, and may prevent the fluid from flowing through the valve in an opposing direction (which may be referred to as backflow). Some valves may include a closing member that seals against a seat to prevent backflow. In some valves, the seat may include an elastic seat insert, which may be used to provide the seal between the seat and the closing member. In some cases, a seat insert of a valve may deteriorate over time as the valve is used. As a result, the seat insert may be periodically replaced.

Various tools may be used to remove or install a seat insert in a valve. One particular tool is disclosed in U.S. Patent Application Publication No. 2011/0173814 that published on Jul. 21, 2011 ("the '814 publication"). In particular, the '814 publication discloses a tool for replacing a valve seat of a reciprocating pump that has a puller shaft connected to a puller head having at least two spring-biased dogs. An operator inserts the puller head into a valve bore and through a valve seat, the dogs retracting as the puller head moves through the valve seat, then snapping back outward. A hydraulic cylinder engages the puller shaft to exert a force on the puller shaft causing the dogs to dislodge the seat. The operator then places a replacement valve seat on a shoulder in the valve bore. The operator attaches an installing head to an installing shaft and inserts the installing head into the valve bore into contact with the replacement valve seat. The hydraulic cylinder applies a force in an opposite direction on the installing shaft to push the replacement valve seat into installed engagement.

While the valve seat installation and retrieval tool of the '814 patent may be used to replace a valve seat of a reciprocating pump, the tool includes parts that are dedicated for retrieving the valve seat (e.g., the puller head) and separate parts that are dedicated for installing the replacement valve seat (e.g., the installing head), which increases the quantity of parts included in the tool, increases the complexity of using the tool, increases the cost of the tool, and/or the like.

The seat insert tool of the present disclosure solves one or more of the problems set forth above and/or other problems in the art.

SUMMARY

According to some implementations, the present disclosure is related to a seat insert tool. The seat insert tool may comprise a seat insert guide that is removably attachable to a threaded rod at an end of the threaded rod, wherein the seat insert guide may include a key. The seat insert tool may include a seat insert jaw that is slidable onto the threaded rod, wherein the seat insert jaw may include a first keyway on a first side of the seat insert jaw, and a second keyway on a second side of the seat insert jaw, wherein the first keyway of the seat insert jaw may engage the key of the seat insert guide when the seat insert tool is used to remove a seat insert from a valve, and wherein the second keyway of the seat insert jaw may engage the key of the seat insert guide when the seat insert tool is used to install the seat insert in the valve.

According to some implementations, the present disclosure is related to a seat insert tool. The seat insert tool may include a threaded rod. The seat insert tool may include a seat insert guide that may be removably attachable to the threaded rod at a first end of the threaded rod, wherein the seat insert guide may include a key. The seat insert tool may include a seat insert jaw that is slidable onto the threaded rod, wherein the seat insert jaw may include a first keyway on a first side of the seat insert jaw, and a second keyway on a second side of the seat insert jaw that is opposite the first side, wherein the key of the seat insert guide may be insertable into the first keyway of the seat insert jaw when the seat insert tool is used to remove a seat insert from a valve, and wherein the key of the seat insert guide may be insertable into the second keyway of the seat insert jaw when the seat insert tool is used to install the seat insert in the valve. The seat insert tool may include a threaded hand crank that threads onto a second end of the threaded rod, wherein the threaded hand crank may be rotated to at least one of remove the seat insert from the valve, or install the seat insert in the valve.

According to some implementations, the present disclosure is related to a method for replacing a seat insert in a valve. The method may include inserting a seat insert jaw of a seat insert tool into a cavity of a valve. The method may include inserting a threaded rod of the seat insert tool into a first end of the valve such that the threaded rod at least partially protrudes from a second end of the valve, wherein the seat insert jaw slides onto the threaded rod in a first orientation as the threaded rod is inserted into the first end of the valve. The method may include threading a threaded hand crank of the seat insert tool onto the threaded rod to remove a seat insert from the valve. The method may include inserting the seat insert jaw of the seat insert tool into the cavity of the valve. The method may include inserting the threaded rod of the seat insert tool into the second end of the valve such that the threaded rod at least partially protrudes from the first end of the valve, wherein the seat insert jaw slides onto the threaded rod in a second orientation as the threaded rod is inserted into the second end of the valve. The method may include threading the threaded hand crank of the seat insert tool onto the threaded rod to install a replacement seat insert in the valve.

DETAILED DESCRIPTION

This disclosure relates to a seat insert tool. The seat insert tool has universal applicability to any valve or machine utilizing such a valve. The term "machine" may refer to any machine that performs an operation associated with an industry such as, for example, mining, construction, farming, transportation, robotics, or any other industry. As some examples, the machine may be a vehicle (e.g., a car, a truck, a boat, a helicopter, an airplane, etc.), a robotic machine, a backhoe loader, a cold planer, a wheel loader, a compactor, a paver, a forest machine, a forwarder, a harvester, an excavator, an industrial loader, a tractor, a dozer, or other type of mining, construction, farming, robotic, and/or transportation equipment.

Figure 1:
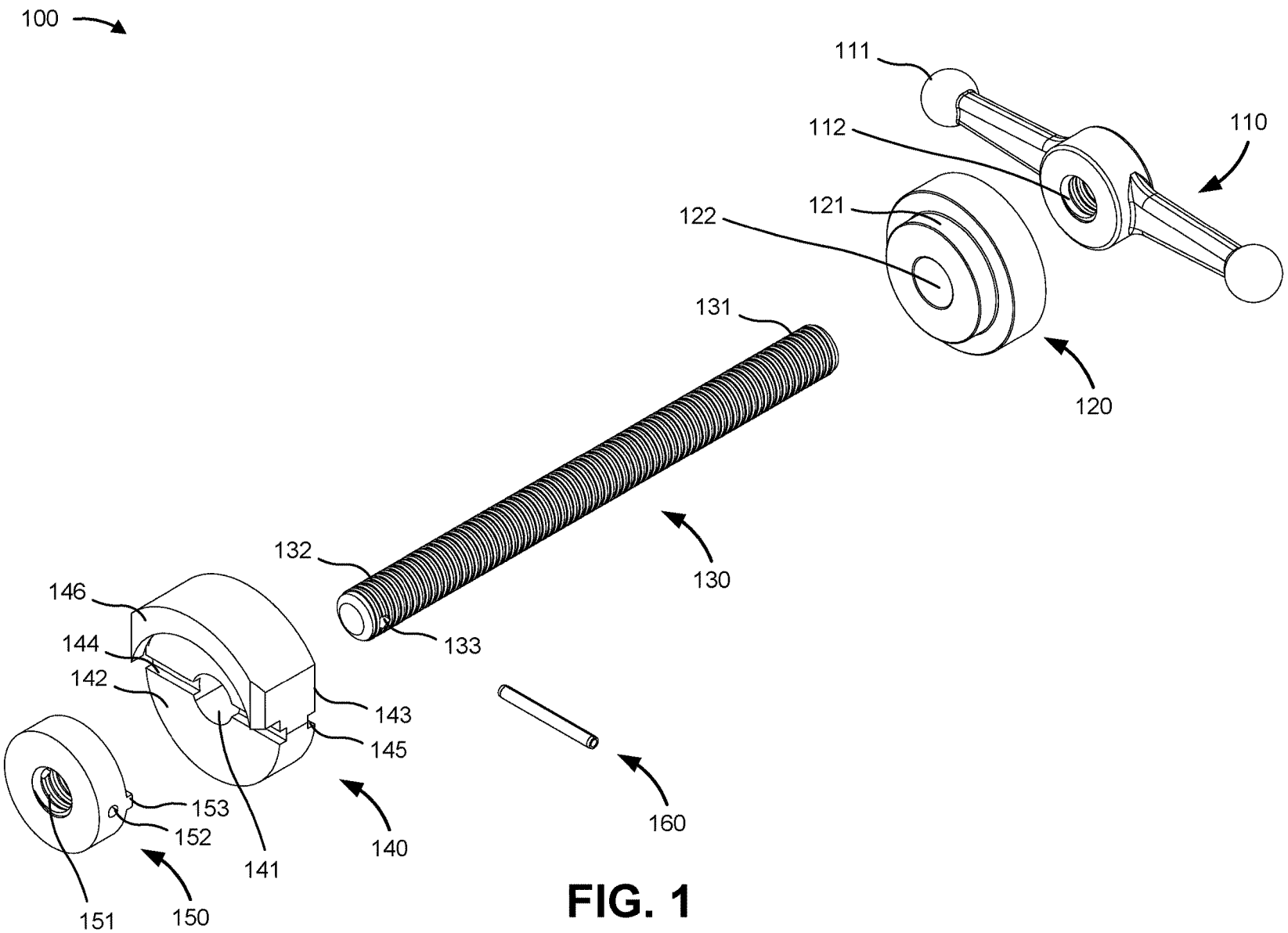
FIG. 1 is a perspective exploded view of an example seat insert tool.

FIG. 1 is a perspective exploded view of an example seat insert tool 100. Seat insert tool 100 may include various components, such as a threaded hand crank 110, an arbor 120, a threaded rod 130, a seat insert jaw 140, a seat insert guide 150, and a pin 160, and/or the like. In some implementations, threaded hand crank 110, arbor 120, threaded rod 130, seat insert jaw 140, seat insert guide 150, and/or pin 160 may be formed of various metals, plastics, and/or other types of materials.

Threaded hand crank 110 may include crank members 111 and a threaded opening 112. Crank members 111 may include one or more wings, a crank wheel, and/or the like, that allow an operator to rotate threaded hand crank 110 (e.g., clockwise, counterclockwise, and/or the like) to be removably attach threaded hand crank 110 to threaded rod 130 and/or removably detach threaded hand crank 110 from threaded rod 130. Threaded hand crank 110 may be removably attached to threaded rod 130 by threading threaded opening 112 onto threaded rod 130.

Arbor 120 may include a step 121 and an opening 122. As shown in FIG. 1, arbor 120 may be a circular shape. However, in other implementations, arbor 120 may be a square shape, an irregular shape, and/or another shape. Step 121 may provide a transition from a first diameter of arbor 120 to a second diameter of arbor 120, such that arbor 120 may at least partially sit in, and rest against, an opening of a valve without falling into the opening. In some implementations, opening 122 may not be threaded, such that arbor 120 may be slidable onto threaded rod 130 by sliding threaded rod 130 through opening 122. However, in some implementations, opening 122 may be a threaded opening and may be threaded onto threaded rod 130.

Threaded rod 130 may include an end 131, an end 132 that is opposite end 131, and a pin hole 133. Threaded rod 130 may be at least partially threaded, fully threaded, and/or the like. Threaded rod 130 may be formed of any length and/or diameter. Pin hole 133 may be sized and/or shaped such that pin 160 may be at least partially inserted into pin hole 133.

Seat insert jaw 140 may include an opening 141, a side 142, a side 143 opposite side 142, a keyway 144 included on side 142, a keyway 145 included on side 143, and a jaw 146. In some implementations, opening 141 may not be threaded, such that seat insert jaw 140 may be slidable onto threaded rod 130 by sliding threaded rod 130 through opening 141. However, in some implementations, opening 141 may be a threaded opening and may be threaded onto threaded rod 130.

Keyway 144 and keyway 145 may each include one or more grooves. For example, keyway 144 may include a plurality of grooves in side 142, wherein a first groove, of the plurality of grooves, is located on a first side of opening 141, and a second groove, of the plurality of grooves, is located on a second side of opening 141. As another example, keyway 145 may include a plurality of grooves in side 143, wherein a first groove, of the plurality of grooves, is located on a first side of opening 141, and a second groove, of the plurality of grooves, is located on a second side of opening 141. In some implementations, keyway 144 and keyway 145 may formed of the same or similar shapes (e.g., square-shaped, trapezoidal-shaped, triangular-shaped, and/or the like) and/or sizes (e.g., the same or similar depth, the same or similar width, and/or the like) such that keyway 144 and keyway 145 a key 153 included on seat insert guide 150 may engage keyway 144 and keyway 145.

Jaw 146 may be formed of a shape and dimensions (e.g., the thickness of the jaw, the depth of the jaw, and/or the like) such that jaw 146 is compatible with a particular seat insert. For example, jaw 146 may be formed such that jaw 146 may engage a notch in a seat insert to pull the seat insert from a seat in a valve.

Seat insert guide 150 may include a threaded opening 151, pin holes 152, and key 153. Threaded opening 151 may allow seat insert guide 150 to be removably attached to threaded rod 130. For example, seat insert guide 150 may be removably attached to threaded rod 130 by threading threaded opening 151 onto threaded rod 130. Seat insert guide 150 may be removably secured in place by inserting pin 160 at least partially into pin holes 152. Pin holes 152 may include a first pin hole on a first side of threaded opening 151 and a second pin hole on a second size of threaded opening 151, such that pin 160 may be inserted through the first pin hole in seat insert guide 150, inserted through pin hole 133 in threaded rod 130, and inserted through the second pin hole in seat insert guide 150, thereby removably securing seat insert guide 150 in place.

Key 153 may engage keyway 144 or key 153 may engage keyway 145 depending on the orientation of seat insert jaw 140. In some implementations, key 153 may be sized and/or shaped complementary to keyway 144 and keyway 145 such that key 153 is capable of engaging keyway 144 or keyway 145, depending on the orientation of seat insert jaw 140. In some implementations, key 153 may include one or more notches that protrude from a same side of seat insert guide 150. For example, key 153 may include a first notch on a first side of threaded opening 151, and may include a second notch on a second side of threaded opening 151. The first notch and the second notch may be located on seat insert guide 150 such that the first notch aligns with the first groove of keyway 144 or the first groove of keyway 145, and such that the second notch aligns with the second groove of keyway 144 or the second groove of keyway 145, when seat insert tool 100 is assembled.

In some implementations, the threads of threaded opening 112 of threaded hand crank 110, threaded rod 130, and threaded opening 151 of seat insert guide 150 may include various properties, such as a threadform (e.g., a cross-sectional shape of the threads, such as a square shape, a trapezoidal shape, a triangular shape, and/or the like), a pitch (e.g., a distance between the crest of two threads), a thread angle (e.g., an angle between two threads), and/or the like. In some implementations, the properties of the threads of threaded opening 112, the properties of the threads of threaded rod 130, and the properties of the threads of threaded opening 151 may be the same or similar such that threaded hand crank 110 may be threaded onto threaded rod 130 and seat insert guide 150 may be threaded onto threaded rod 130. In some implementations, threaded rod 130 may include two sets of threads having different properties (e.g., end 131 may include the first set of threads and end 132 may include the second set of threads) such that only threaded hand crank 110 may be threaded on one end of threaded rod 130 (e.g., end 131) and only seat insert guide 150 may be threaded onto another end (e.g., end 132). In this way, an operator that is using seat insert tool 100 to replace a seat insert in a valve is prevented from improperly assembling seat insert tool 100 (e.g., by threading seat insert guide 150 onto end 131 and/or by threading threaded hand crank 110 onto end 132).

As indicated above, FIG. 1 is provided as an example. Other examples are possible and may differ from what was described in connection with FIG. 1.

Figure 2:
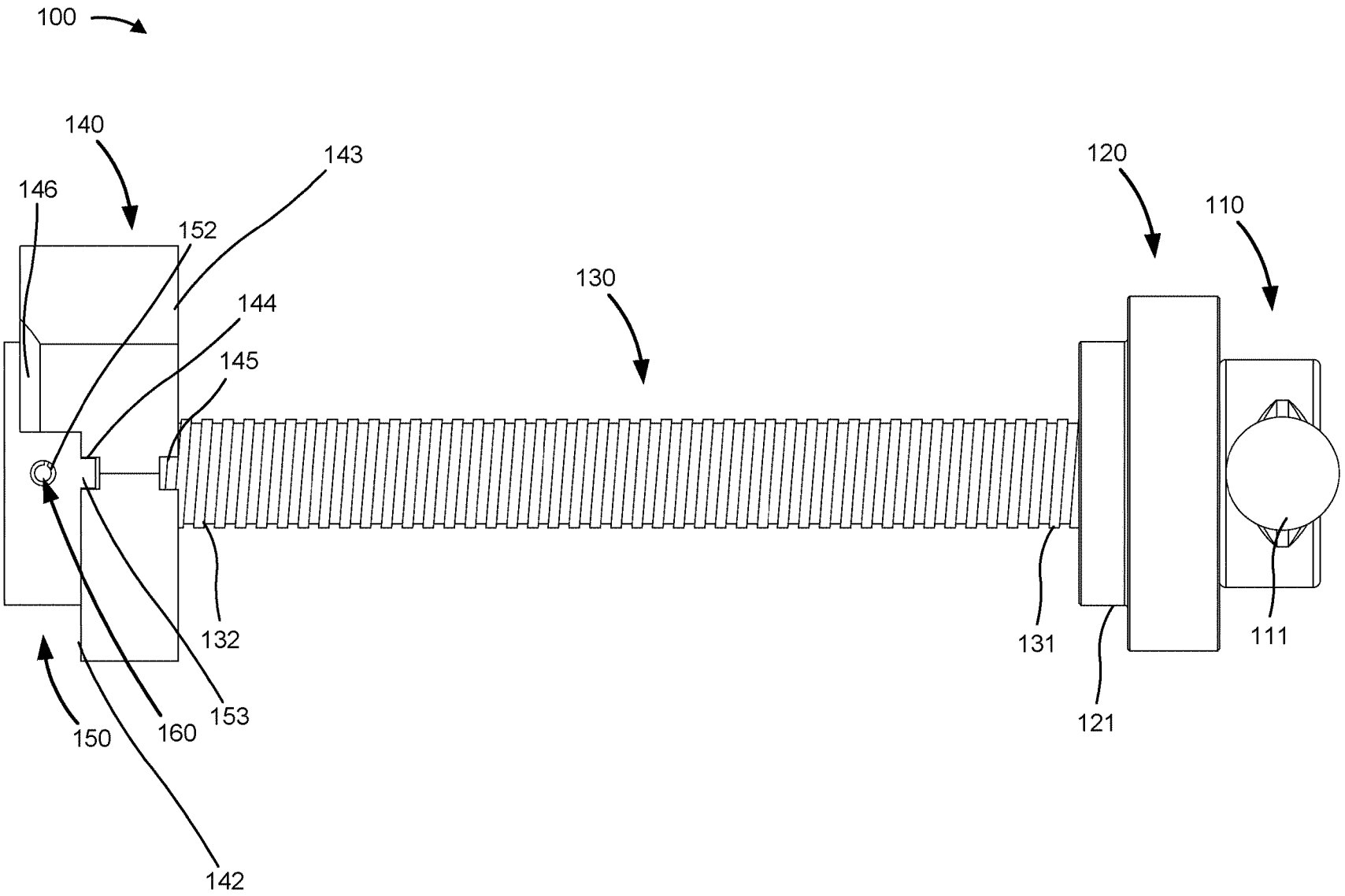
FIG. 2 is a side assembled view of the example seat removal tool of FIG. 1.

FIG. 2 is a side assembled view of seat insert tool 100. As shown in FIG. 2, arbor 120 may slide onto threaded rod 130 by sliding end 131 or end 132 of threaded rod 130 through opening 122 in arbor 120. Threaded hand crank 110 may be removably attached to threaded rod 130 at end 131 by rotating threaded hand crank 110, using crank members 111, such that threaded opening 112 threads onto threaded rod 130.

Seat insert jaw 140 may slide onto threaded rod 130 by sliding end 131 or end 132 of threaded rod 130 through opening 141 in seat insert jaw 140. Seat insert guide 150 may be removably attached to threaded rod 130 at end 132 by rotating seat insert guide 150 such that threaded opening 151 threads onto threaded rod 130. Pin 160 may be inserted through pin holes 152 in seat insert guide 150, and through pin hole 133 in threaded rod 130, to removably secure seat insert guide 150 to threaded rod 130.

In some implementations, the assembled view of seat insert tool 100 in FIG. 2 may be a seat insert removal configuration. In the seat insert removal configuration, side 142 of seat insert jaw 140 rests against seat insert guide such that key 153 of seat insert guide 150 engages keyway 144 on side 142 of seat insert. In this way, key 153 is inserted into keyway 144 such that seat insert jaw 140 is prevented from rotating when in the seat insert removal configuration.

As indicated above, FIG. 2 is provided as an example. Other examples are possible and may differ from what was described in connection with FIG. 2. For example, seat insert tool 100 may be assembled into other configurations, such as a seat insert installation configuration. The seat insert removal configuration and the seat insert installation configuration of seat insert tool 100 may be similar, except that seat insert jaw 140 may be oriented in a configuration, in the seat insert installation configuration, that is different from the orientation of seat insert jaw 140 when seat insert tool 100 is in the seat insert removal installation configuration. As explained above, when seat insert tool 100 is assembled in the seat insert removal configuration, side 142 of seat insert jaw 140 may rest against seat insert guide 150 such that key 153 engages keyway 144 on side 142. When seat insert tool 100 is assembled in the seat insert installation configuration, seat insert jaw 140 may be rotated 180 degrees such that side 143 rests against seat insert guide 150, and key 153 engages with keyway 145 on side 143.

INDUSTRIAL APPLICABILITY

The disclosed seat insert tool 100 may be used with any valve where proper maintenance and/or operation of the valve is desired. For example, the disclosed seat insert tool 100 may be used to maintain a valve by replacing a seat insert included in the valve. Over time, the operation of the valve may cause the seat insert to deteriorate (e.g., due to pressure from fluid flowing through the valve, due to repeated opening and closing of a closing member, included in the valve, onto the seat insert, and/or the like), and accordingly the disclosed seat insert tool 100 may be used to remove the seat insert from the valve and install a replacement seat insert in the valve. Operation of seat insert tool 100 will now be explained.

Figure 3:
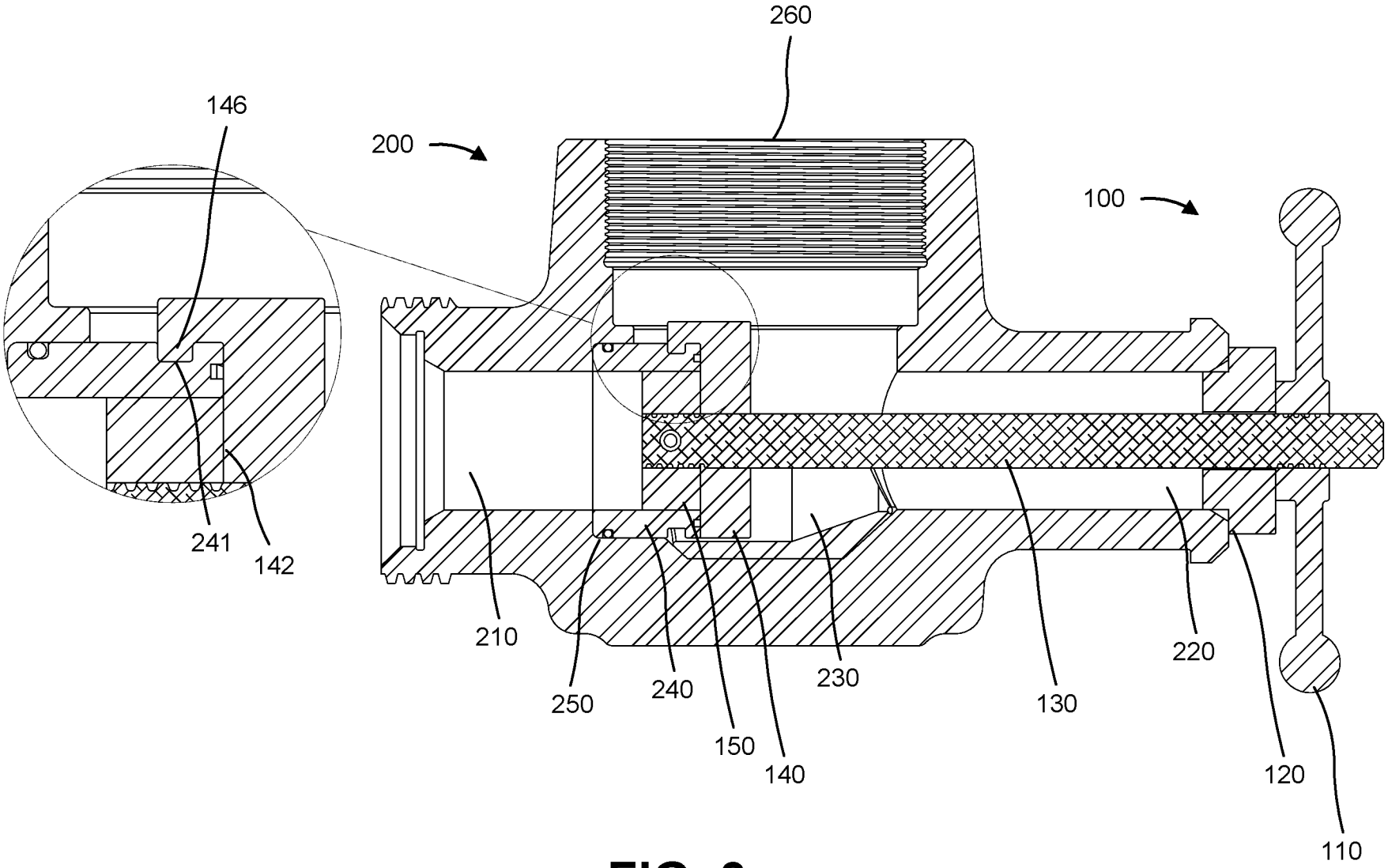
FIG. 3 is a cross-sectional view of the seat insert tool of FIG. 1 being used to remove a seat insert from a valve.

FIG. 3 is a cross-sectional view of seat insert tool 100 being used to remove a seat insert 240 from a valve 200. In some implementations, valve 200 may be any type of valve that uses a replaceable seat insert, such as a swing check valve, a ball check valve, an inline check valve, and/or the like. As shown in FIG. 3, valve 200 may include various components, such as an opening 210, an opening 220 at an opposite end of valve 200 from opening 210, a cavity 230 between and connecting opening 210 and opening 220, a seat insert 240, a seat 250, and a top opening 260, and/or the like.

Opening 210 may function as an inlet for fluid into valve 200, and opening 220 may function as an outlet for fluid that enters valve 200 via opening 210. Valve 200 may include a closing member (not shown for purposes of clarity) that rests against seat insert 240 to form a seal, which prevents fluid from backflowing into opening 210. This ensures a one-way flow of fluid in valve 200 (e.g., from opening 210 to opening 220. Seat insert 240 may sit in seat 250. Seat insert 240 may be compression-fit into seat 250 such that seat insert 240 does not become dislodged in operation of valve 200 due to pressure from fluid flowing through valve 200. A plug (not shown for purposes of clarity) may be removably attached to valve 200 at top opening 260 such that the plug may be removed from top opening 260 (e.g., by de-threading the plug from top opening 260, by pulling the plug out of top opening 260, and/or the like) in order to perform maintenance on valve 200, such as replacing seat insert 240, repairing and/or replacing the closing member, and/or the like. In some implementations, top opening 260 may be a bottom opening, a side opening, and/or any other location on valve 200.

To remove seat insert 240 from seat 250, an operator may detach the plug from valve 200 in order to gain access to cavity 230. Once the plug has been detached from valve 200, the operator may insert seat insert jaw 140 into cavity 230 such that seat insert jaw 140 is inserted in cavity 230 in a first orientation (e.g., an orientation where side 142, keyway 144, and jaw 146 are facing seat insert 240).

If not already removably attached to threaded rod 130, the operator may removably attach seat insert guide 150 to threaded rod 130. For example, the operator may attach seat insert guide 150 at an end of threaded rod 130 where pin hole 133 is located (e.g., end 132) by threading seat insert guide 150 onto threaded rod 130 via threaded opening 151. The operator may insert pin 160 into pin holes 152 in seat insert guide 150 and pin hole 133 in threaded rod 130 to secure seat insert guide 150 in place such that seat insert guide 150 is prevented from rotating (and thus becoming detached from threaded rod 130).

With seat insert guide 150 removably attached to threaded rod 130, the operator may insert threaded rod 130 into opening 210 of valve 200 such that an end (e.g., end 131) of threaded rod 130 opposing the end at which seat insert guide 150 is removably attached to threaded rod 130 is inserted into opening 210 first. The operator may continue to insert threaded rod 130 through opening 210, through seat 250, through seat insert 240, and through cavity 230, such that threaded rod 130 at least partially protrudes from valve 200 at opening 220. When in place, seat insert guide 150 may sit in seat insert 240. Accordingly, seat insert guide 150 may be sized and/or shaped such that seat insert guide 150 fits into seat insert 240. In this way, seat insert guide 150 may prevent seat insert tool 100 from moving around in cavity 230, which may prevent seat insert tool 100 from causing damage to valve 200 during removal of seat insert 240.

While inserting threaded rod through cavity 230, the operator may ensure that threaded rod 130 slides through opening 141 in seat insert jaw 140 while seat insert jaw 140 is in cavity 230. The operator may ensure that jaw 146 of seat insert jaw 140 engages with groove 241 in seat insert 240. The interface between jaw 146 and groove 241 may allow seat insert tool 100 to apply a force, to seat insert 240, that is greater than the compression force applied to seat insert 240 by seat 250, such that the force applied by seat insert tool 100 pulls seat insert 240 out of seat 250. Moreover, the operator may ensure that key 153 of seat insert guide 150 is inserted into keyway 144 of seat insert jaw 140, which prevents seat insert jaw 140 from rotating in cavity 230, which in turn prevents seat insert jaw 140 from damaging valve 200.

The operator may slide arbor 120 over the end of threaded rod 130 that is at least partially protruding from opening 220 in valve 200 (e.g., end 131). The operator may slide arbor 120 onto threaded rod 130 until arbor 120 is resting against, and at least partially in, opening 220. Step 121 of arbor 120 may prevent arbor 120 from fully sliding along threaded rod 130 into opening 220, and may function to stabilize threaded rod 130 in valve 200, which prevents seat insert tool 100 from causing damage to valve 200.

The operator may thread threaded hand crank 110 onto the end of threaded rod 130 that is at least partially protruding from opening 220 (e.g., end 131). The operator may rotate threaded hand crank 110 such that threaded hand crank 110 is pressed against arbor 120. As the operator continues to rotate threaded hand crank 110, threaded hand crank 110 becomes further threaded onto threaded rod 130, which pulls seat insert guide 150, and thus seat insert jaw 140, in the direction of opening 220. The pulling of seat insert jaw 140 in the direction of opening 220 causes jaw 146 of seat insert jaw 140 to apply a pulling force to seat insert 240. The operator may rotate threaded hand crank 110 until the pulling force on seat insert 240 causes seat insert 240 to become dislodged from seat 250.

Once seat insert 240 is dislodged from seat 250, the operator may retrieve seat insert 240 from cavity 230. To remove seat insert tool 100 from valve 200, the operator may detach threaded hand crank 110 from threaded rod 130 (e.g., by rotating threaded hand crank 110 in a direction opposite the direction used to removably attach threaded hand crank 110 to threaded rod 130 until threaded hand crank 110 is fully de-threaded from threaded rod 130). The operator may slide arbor 120 off of threaded rod 130, and may push threaded rod 130 through valve 200 until threaded rod 130 is fully removed through opening 210.

As indicated above, FIG. 3 is provided as an example. Other examples are possible and may differ from what was described in connection with FIG. 3.

Figure 4:
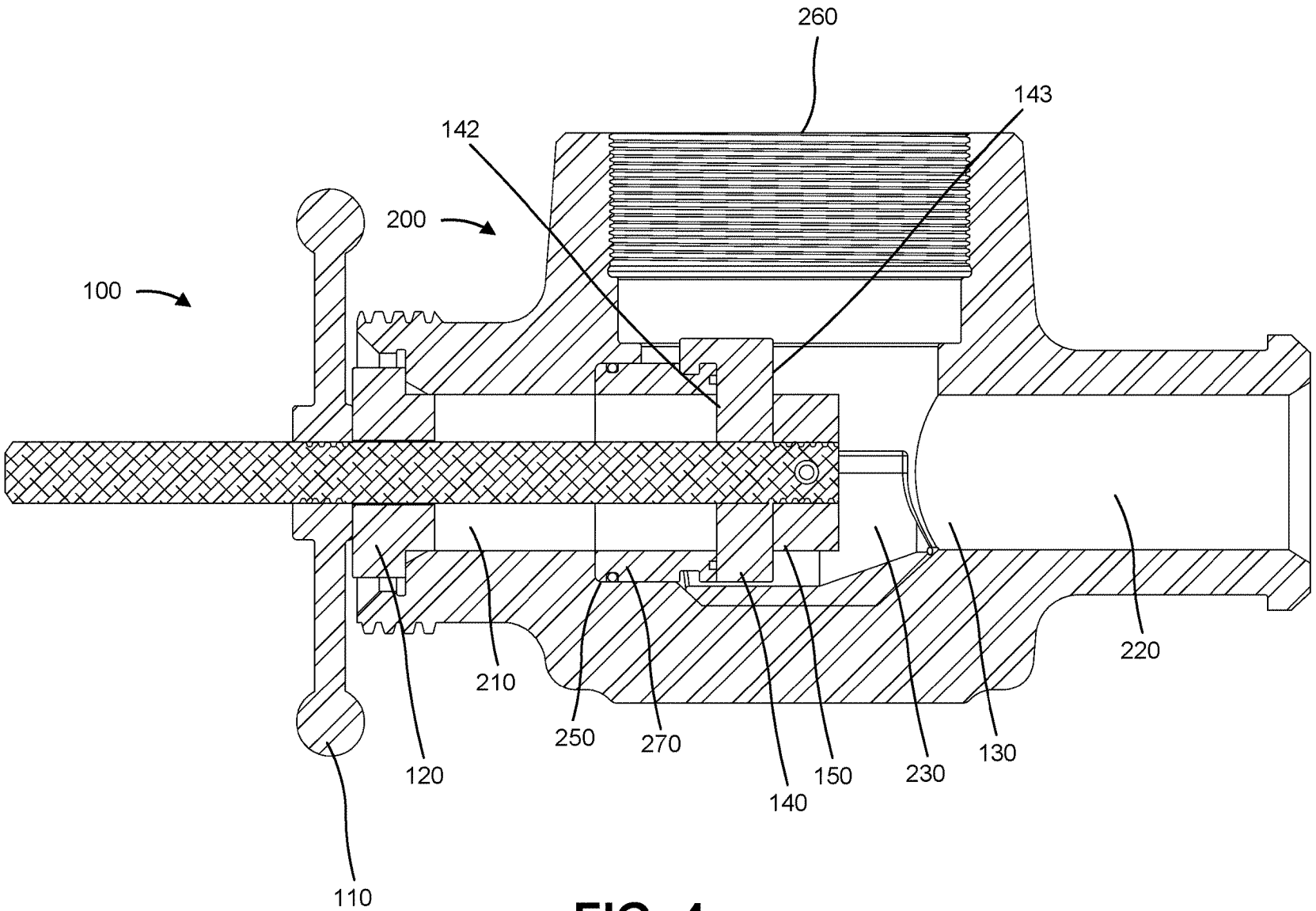
FIG. 4 is a cross-sectional view of the seat insert tool of FIG. 1 being used to install a replacement seat insert in the valve shown in FIG. 3.

FIG. 4 is a cross-sectional view of seat insert tool 100 being used to install a replacement seat insert 270 in valve 200. To install replacement seat insert 270 in seat 250, an operator may detach the plug from valve 200 (e.g., if not already removed) in order to gain access to cavity 230. Once the plug has been detached from valve 200, the operator may insert replacement seat insert 270 into cavity 230 such that replacement seat insert 270 is near and/or at least partially aligned with seat 250. The operator may also insert seat insert jaw 140 into cavity 230 such that seat insert jaw 140 is inserted in cavity 230 in a second orientation different from the first orientation of seat insert jaw 140 when using seat insert tool 100 to remove seat insert 240 from valve 200 (e.g., an orientation where side 143 and keyway 145 are facing replacement seat insert 270).

If not already removably attached to threaded rod 130, the operator may removably attach seat insert guide 150 to threaded rod 130. For example, the operator may attach seat insert guide 150 at an end of threaded rod 130 where pin hole 133 is located (e.g., end 132) by threading seat insert guide 150 onto threaded rod 130 via threaded opening 151. The operator may insert pin 160 into pin holes 152 in seat insert guide 150 and pin hole 133 in threaded rod 130 to secure seat insert guide 150 in place such that seat insert guide 150 is prevented from rotating (and thus becoming detached from threaded rod 130).

With seat insert guide 150 removably attached to threaded rod 130, the operator may insert threaded rod 130 into opening 220 of valve 200 such that an end (e.g., end 131) of threaded rod 130 opposing the end at which seat insert guide 150 is removably attached to threaded rod 130 is inserted into opening 220 first. The operator may continue to insert threaded rod 130 through opening 220, through cavity 230, through replacement seat insert 270, and through seat 250, such that threaded rod 130 at least partially protrudes from valve 200 at opening 210.

While inserting threaded rod through cavity 230, the operator may ensure that threaded rod 130 slides through opening 141 in seat insert jaw 140 while seat insert jaw 140 is in cavity 230. The operator may ensure that jaw 146 of seat insert jaw 140 engages with groove 241 in replacement seat insert 270. The interface between jaw 146 and groove 241 may allow the operator to properly align replacement seat insert 270 with seat 250 and side 142 of seat insert jaw 140, which may prevent seat 250 and/or seat insert tool 100 from damaging replacement seat insert 270 during installation. Moreover, the operator may ensure that key 153 of seat insert guide 150 is inserted into keyway 145 of seat insert jaw 140, which prevents seat insert jaw 140 from rotating in cavity 230, which in turn prevents seat insert jaw 140 from damaging valve 200.

The operator may slide arbor 120 over the end of threaded rod 130 that is at least partially protruding from opening 210 in valve 200 (e.g., end 131). The operator may slide arbor 120 onto threaded rod 130 until arbor 120 is resting against, and at least partially in, opening 210. Step 121 of arbor 120 may prevent arbor 120 from fully sliding along threaded rod 130 into opening 210, and may function to stabilize threaded rod 130 in valve 200, which prevents seat insert tool 100 from causing damage to valve 200.

The operator may thread threaded hand crank 110 onto the end of threaded rod 130 that is at least partially protruding from opening 210 (e.g., end 131). The operator may rotate threaded hand crank 110 such that threaded hand crank 110 is pressed against arbor 120. As the operator continues to rotate threaded hand crank 110, threaded hand crank 110 becomes further threaded onto threaded rod 130, which pulls seat insert guide 150, and thus seat insert jaw 140, in the direction of opening 210. The pulling of seat insert jaw 140 in the direction of opening 210 causes side 142 and jaw 146 of seat insert jaw 140 to apply a pushing force to replacement seat insert 270. The operator may rotate threaded hand crank 110 until the pushing force on replacement seat insert 270 causes replacement seat insert 270 to become fully seated in seat 250.

Once replacement seat insert 270 is fully seated in seat 250, the operator may remove seat insert tool 100 from valve 200 by detaching threaded hand crank 110 from threaded rod 130 (e.g., by rotating threaded hand crank 110 in a direction opposite the direction used to removably attach threaded hand crank 110 to threaded rod 130 until threaded hand crank 110 is fully de-threaded from threaded rod 130). The operator may slide arbor 120 off of threaded rod 130, and may push threaded rod 130 through valve 200 until threaded rod 130 is fully removed through opening 220.

As indicated above, FIG. 4 is provided as an example. Other examples are possible and may differ from what was described in connection with FIG. 4.

Figure 5:
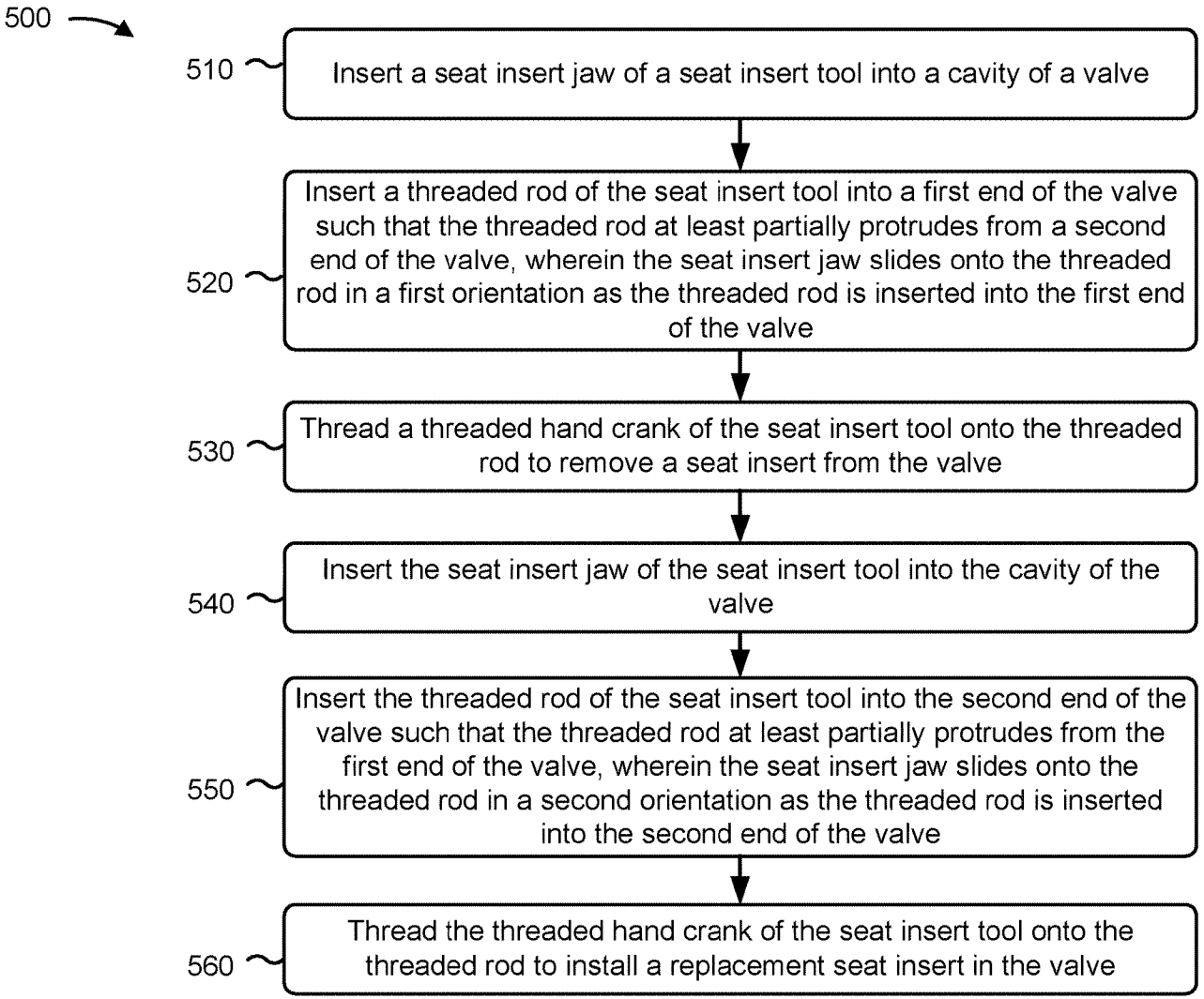
FIG. 5 is a flow chart of an example process for replacing a seat insert in a valve.

FIG. 5 is a flow chart of an example process 500 for replacing a seat insert in a valve. In some implementations, one or more process blocks of FIG. 5 may include the use of a seat insert tool (e.g., seat insert tool 100). In some implementations, one or more process blocks of FIG. 5 may include the use of another device or a group of devices separate from or including the seat insert tool, such as a valve (e.g., valve 200).

As shown in FIG. 5, process 500 may include inserting a seat insert jaw of the seat insert tool into a cavity of the valve (block 510). For example, a seat insert jaw of the seat insert tool may be inserted into a cavity of the valve, as described above in connection with FIGS. 1-4.

As further shown in FIG. 5, process 500 may include inserting a threaded rod of the seat insert tool into a first end of the valve such that the threaded rod at least partially protrudes from a second end of the valve, wherein the seat insert jaw slides onto the threaded rod in a first orientation as the threaded rod is inserted into the first end of the valve (block 520). For example, a threaded rod of the seat insert tool may be inserted into a first end of the valve such that the threaded rod at least partially protrudes from a second end of the valve, as described above in connection with FIGS. 1-4. In some implementations, the seat insert jaw may slide onto the threaded rod in a first orientation as the threaded rod is inserted into the first end of the valve.

As further shown in FIG. 5, process 500 may include threading a threaded hand crank of the seat insert tool onto the threaded rod to remove a seat insert from the valve (block 530). For example, a threaded hand crank of the seat insert tool may be threaded onto the threaded rod to remove a seat insert from the valve, as described above in connection with FIGS. 1-4.

As further shown in FIG. 5, process 500 may include inserting the seat insert jaw of the seat insert tool into the cavity of the valve (block 540). For example, the seat insert jaw of the seat insert tool may be inserted into the cavity of the valve, as described above in connection with FIGS. 1-4.

As further shown in FIG. 5, process 500 may include inserting the threaded rod of the seat insert tool into the second end of the valve such that the threaded rod at least partially protrudes from the first end of the valve, wherein the seat insert jaw slides onto the threaded rod in a second orientation as the threaded rod is inserted into the second end of the valve (block 550). For example, the threaded rod of the seat insert tool may be inserted into the second end of the valve such that the threaded rod at least partially protrudes from the first end of the valve, as described above in connection with FIGS. 1-4. In some implementations, the seat insert jaw may slide onto the threaded rod in a second orientation as the threaded rod is inserted into the second end of the valve.

As further shown in FIG. 5, process 500 may include threading the threaded hand crank of the seat insert tool onto the threaded rod to install a replacement seat insert in the valve (block 560). For example, the threaded hand crank of the seat insert tool may be threaded onto the threaded rod to install a replacement seat insert in the valve, as described above in connection with FIGS. 1-4.

Process 500 may include additional implementations, such as any single implementation or any combination of implementations described below and/or described with regard to any other process described herein.

In some implementations, the seat insert tool may include a seat insert guide removably attached to the first end of the threaded rod, wherein the seat insert guide may press against a first side of the seat insert jaw when the seat insert jaw is slid onto the threaded rod in the first orientation, and wherein the seat insert guide may press against a second side of the seat insert jaw, opposite the first side, when the seat insert jaw is slid onto the threaded rod in the second orientation.

In some implementations, the seat insert tool may include a seat insert guide removably attached to the first end of the threaded rod, wherein a key of the seat insert guide may be insertable into a first keyway of the seat insert jaw when the seat insert jaw is slid onto the threaded rod in the first orientation to prevent the seat insert jaw from rotating when in the first orientation, and wherein the key of the seat insert guide may be insertable into a second keyway of the seat insert jaw when the seat insert jaw is slid onto the threaded rod in the second orientation to prevent the seat insert jaw from rotating when in the second orientation.

In some implementations, the seat insert tool may include a seat insert guide removably attached to the first end of the threaded rod, wherein the seat insert guide may be threaded onto the first end of the threaded rod, and wherein the seat insert guide may be secured in place by a pin that is at least partially inserted through the seat insert guide and the threaded rod.

In some implementations, the seat insert tool may include an arbor that is slidable onto the threaded rod, wherein the arbor is pressed against the first end of the valve when the threaded hand crank is threaded onto the threaded rod to remove the seat insert from the valve, and wherein the arbor is pressed against the second end of the valve when the threaded hand crank is threaded onto the threaded rod to install the replacement seat insert in the valve.

In some implementations, threading the threaded hand crank of the seat insert tool onto the threaded rod to remove the seat insert from the valve may include threading the threaded hand crank of the seat insert tool onto the threaded rod to pull the seat insert out of a seat of the valve. In some implementations, threading the threaded hand crank of the seat insert tool onto the threaded rod to install the replacement seat insert in the valve may include threading the threaded hand crank of the seat insert tool onto the threaded rod to pull the seat insert into a seat of the valve.

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

Several advantages may be associated with seat insert tool 100. For example, seat insert tool 100 may be used to replace a seat insert of a valve without having to use separate tools for removing the seat insert from the valve and installing a replacement seat insert in the valve, which reduces the cost and complexity of replacing a seat insert in a valve, and reduces the amount of time it takes to replace the seat insert in the valve (e.g., since an operator no longer needs to switch between different tools for removing the seat insert and installing a replacement seat insert). Moreover, the disclosed seat insert tool 100 is capable of replacing a seat insert in a valve without having to use additional and/or dedicated components for removal of the seat insert and installation of a replacement seat insert, which reduces the complexity of seat insert tool 100, reduces the cost of seat insert tool 100, and reduces the possibility of components of seat insert tool 100 being lost or misplaced. Further, the disclosed seat insert tool 100 is capable of being used by an operator without having to use other tools, such as hand tools to tighten nuts and/or bolts, to operate seat insert tool 100, which simplifies the use and operation of seat insert tool 100.

As used herein, the articles "a" and "an" are intended to include one or more items, and may be used interchangeably with "one or more." Also, as used herein, the terms "has," "have," "having," or the like are intended to be open-ended terms. Further, the phrase "based on" is intended to mean "based, at least in part, on."

The foregoing disclosure provides illustration and description, but is not intended to be exhaustive or to limit the implementations to the precise form disclosed. Modifications and variations are possible in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of possible implementations. Although each dependent claim listed below may directly depend on only one claim, the disclosure of possible implementations includes each dependent claim in combination with every other claim in the claim set.

What is claimed is:

1. A seat insert tool, comprising:

a seat insert guide that is removably attachable to a threaded rod at an end of the threaded rod, wherein the seat insert guide comprises a key; and a seat insert jaw that is slidable onto the threaded rod, wherein the seat insert jaw comprises:

a first keyway on a first side of the seat insert jaw, and a second keyway on a second side of the seat insert jaw, wherein the first keyway of the seat insert jaw engages the key of the seat insert guide when the seat insert tool is used to remove a seat insert from a valve, and wherein the second keyway of the seat insert jaw engages the key of the seat insert guide when the seat insert tool is used to install the seat insert in the valve.

2. The seat insert tool of claim 1, further comprising:

a threaded hand crank that threads onto another end of the threaded rod that is opposite the end of the threaded rod, wherein the threaded hand crank is rotated to at least one of:

remove the seat insert from the valve, or install the seat insert in the valve.

3. The seat insert tool of claim 1, wherein the seat insert guide is removably attachable to the threaded rod by a pin inserted at least partially through the seat insert guide and the threaded rod.

4. The seat insert tool of claim 1, wherein the seat insert jaw is slidable onto the threaded rod in a first orientation such that the first side of the seat insert jaw engages the seat insert guide when the seat insert tool is used to remove the seat insert from the valve, and wherein the seat insert jaw is slidable onto the threaded rod in a second orientation such that the second side of the seat insert jaw engages the seat insert guide when the seat insert tool is used to install the seat insert in the valve.

5. The seat insert tool of claim 1, wherein the key and the first keyway prevent the seat insert jaw from rotating when the seat insert tool is used to remove the seat insert from the valve, and wherein the key and the second keyway prevent the seat insert jaw from rotating when the seat insert tool is used to install the seat insert in the valve.

6. The seat insert tool of claim 1, wherein the key comprises at least one notch, wherein the first keyway comprises at least one first groove that engages the at least one notch when the seat insert tool is used to remove the seat insert from the valve, and wherein the second keyway comprises at least one second groove that engages the at least one notch when the seat insert tool is used to install the seat insert in the valve.

7. The seat insert tool of claim 1, further comprising:

an arbor that is slidable onto the threaded rod, wherein the arbor is pressed against a first opening in the valve when the seat insert tool is used to remove the seat insert from the valve, and wherein the arbor is pressed against a second opening in the valve when the seat insert tool is used to install the seat insert in the valve.

8. A seat insert tool, comprising:

a threaded rod;

a seat insert guide that is removably attachable to the threaded rod at a first end of the threaded rod, wherein the seat insert guide comprises a key;

a seat insert jaw that is slidable onto the threaded rod, wherein the seat insert jaw comprises:

a first keyway on a first side of the seat insert jaw, and a second keyway on a second side of the seat insert jaw that is opposite the first side, wherein the key of the seat insert guide is insertable into the first keyway of the seat insert jaw when the seat insert tool is used to remove a seat insert from a valve, and wherein the key of the seat insert guide is insertable into the second keyway of the seat insert jaw when the seat insert tool is used to install the seat insert in the valve; and a threaded hand crank that threads onto a second end of the threaded rod, wherein the threaded hand crank is rotated to at least one of:

remove the seat insert from the valve, or install the seat insert in the valve.

9. The seat insert tool of claim 8, wherein the seat insert guide is removably attachable to the threaded rod by threading the seat insert guide onto the threaded rod at the first end of the threaded rod and securing the seat insert guide in place with a pin.

10. The seat insert tool of claim 8, further comprising:

an arbor that is slidable onto the threaded rod, wherein the threaded hand crank presses the arbor against a first opening in the valve when the threaded hand crank is rotated to remove the seat insert from the valve, and wherein the threaded hand crank presses the arbor against a second opening in the valve when the threaded hand crank is rotated to install the seat insert in the valve.

11. The seat insert tool of claim 8, wherein the key of the seat insert guide comprises:

a plurality of notches on a same side of the seat insert guide.

12. The seat insert tool of claim 8, wherein the first keyway of the seat insert jaw comprises:

a plurality of first grooves in the first side of the seat insert jaw, and wherein the second keyway of the seat insert jaw comprises:

a plurality of second grooves in the second side of the seat insert jaw.

13. The seat insert tool of claim 8, wherein the seat insert guide is sized such that the seat insert guide fits into the seat insert.

* * * * *